US006883532B2

(12) United States Patent
Rau

(10) Patent No.: US 6,883,532 B2
(45) Date of Patent: Apr. 26, 2005

(54) LARGE-SCALE MANIPULATOR COMPRISING A VIBRATION DAMPER

(75) Inventor: Kurt Rau, Hammersbach (DE)

(73) Assignee: Putzmeister Aktiengesellschaft (DE)

( * ) Notice: Subject to any disclaimer, the term of this patent is extended or adjusted under 35 U.S.C. 154(b) by 212 days.

(21) Appl. No.: 10/380,636

(22) PCT Filed: Jul. 4, 2001

(86) PCT No.: PCT/EP01/07617

§ 371 (c)(1),
(2), (4) Date: Mar. 14, 2003

(87) PCT Pub. No.: WO02/25036

PCT Pub. Date: Mar. 28, 2002

(65) Prior Publication Data

US 2003/0196506 A1 Oct. 23, 2003

(30) Foreign Application Priority Data

Sep. 19, 2000 (DE) ..... 100 46 546

(51) Int. Cl.[7] ..... G05G 9/00; E04G 21/04

(52) U.S. Cl. ..... 137/1; 137/615; 141/387; 91/361

(58) Field of Search ..... 137/615, 1; 141/387, 141/388; 91/361

(56) References Cited

U.S. PATENT DOCUMENTS 4,828,033 A * 5/1989 Frison ..... 137/615
5,640,996 A * 6/1997 Schlecht et al. ..... 137/615
5,832,730 A * 11/1998 Mizui ..... 91/361

FOREIGN PATENT DOCUMENTS

| | | | |
|---|---|---|---|
| DE | 43 06 127 | 9/1994 | ..... B25J/5/00 |
| DE | 44 12 643 | 3/1995 | ..... B25J/5/00 |
| DE | 195 20 166 | 11/1995 | ..... B65G/53/32 |
| DE | 195 00 738 | 4/1996 | ..... G05D/13/52 |
| DE | 915 03 895 | 8/1996 | ..... E04G/21/04 |

* cited by examiner

*Primary Examiner*—Kevin Lee
(74) *Attorney, Agent, or Firm*—Pendorf & Cutliff

(57) ABSTRACT

The invention relates to a large-scale manipulator, especially of concrete pumps. Said large-scale manipulator has a bending boom (22) which consists of at least three boom arms (23 to 27) and which is preferably configured as a concrete spreader boom. The arms of said boom are each pivotable to a limited extent about horizontal bending axes (28 to 32) which are parallel to each other, by means of a drive aggregate (34 to 38), respectively. A control device (50, 62, 52) for moving the boom with the help of actuating mechanisms that are allocated to the individual drive aggregates, and means for damping mechanical vibrations in the bending boom are also provided.

21 Claims, 3 Drawing Sheets

LARGE-SCALE MANIPULATOR COMPRISING A VIBRATION DAMPER

CROSS REFERENCE TO RELATED APPLICATION

This application is a national stage of PCT/EP01/07617 filed Jul. 4, 2001 and based upon DE 100 46 546.3 filed Sep. 19, 2000 under the International Convention.

BACKGROUND OF THE INVENTION

Field of the Invention

The invention concerns a large-scale manipulator, in particular for concrete pumps, with a boom block seated on a frame and preferably rotatable about a vertical axis of rotation, with a bendable boom comprised of at least three boom arms, preferably configured as a concrete placement boom, of which the boom arms are pair-wise limitedly pivotable with respect to the adjacent boom block or boom arms respectively about parallel horizontal pivot axes by means of drive aggregates, with a preferably remote controlled control device for movement of the boom with the aid of the actuating mechanisms associated with the individual drive aggregates, and with means for dampening the mechanical oscillation of the bendable boom.

The bendable boom of a large-scale manipulator of this type is, due to its construction, a system capable of elastic oscillation, which can be excited to internal oscillations. A resonance excitation to such oscillations can lead thereto, that the boom tip oscillates with amplitudes of one meter or more. An excitation to oscillation could be for example the pulsing operation of a concrete pump and the therefrom resulting periodic acceleration and retardation of the column of concrete forced through the conveyance line. This has the consequence that the concrete no longer can be evenly distributed, and the worker, who is guiding the end of the hose, is endangered. In order to avoid this, it has been proposed with a known concrete pump with bendable boom (DE-A 195 03 895) to use a position control logic or circuit, which stabilizes the level of the boom tip with respect to a positionally fixed horizontal reference plane within a predetermined variation domain. For this a sensor arrangement is provided, via the output signal of which a coordinate control drive for the compensating control of the boom tip or the hose end is controllable. It has been found, that this measure is quite complex and does not always lead to the desired result. The arm movement sensor is only activated for regulation when a movement has already been carried out, in which case it may already be too late. Thus, a sufficient control quality cannot be achieved therewith.

SUMMARY OF THE INVENTION

Beginning therewith, it is the task of the present invention to provide devices and process means, with which with simple means an optimal boom damping can be made possible.

For the solution of this task the combination of characterizing features set forth in claims 1 and 15 are proposed. Advantageous embodiments and further developments of the invention can be seen in the dependent claims.

The inventive solution is based on the idea, that on at least a time-dependent measurement amplitude of the mechanical oscillation of the concerned boom arm is derived from one of the drive aggregates, or on associated boom arms, is processed in an evaluation unit with formation of a dynamic damping signal and is offered to an actuating mechanism controlling the associated drive aggregate.

According to a preferred design of the invention, in which the drive aggregate is in the form a double acting hydraulic cylinder, the time dependent pressure differential between piston head and piston rod side of the hydraulic cylinder is determined as measurement amplitude and processed in the evaluation unit for formation of the dynamic damping signal. In the signal preparation, the dynamic portion of the time dependent pressure differential above a defined cutoff frequency is preferably filtered out and phase delayed and/or amplified for the formation of the damping signal. The cutoff frequency is set depending upon the dimension of the mechanical internal harmonic frequency of the concerned boom arm, preferably in the range of 0.2 to 10 Hz. In any case the cutoff frequency of the high pass filter should be selected to be somewhat lower than the harmonic frequency of the concerned boom arm. Since boom dampening, without taking position control into consideration, can result in an undesired drift of the boom tip, it is proposed in accordance with a preferred or alternative embodiment of the invention, that in the case of a bendable boom driven out to a defined work position the inclination or distance from the ground of the end of the arm of the bendable boom is measured at fixed time intervals and compared with a stored intended value, and that upon the occurrence of a drift the bendable boom is returned by control of at least one of the actuating mechanisms.

For carrying out the described process it is proposed in accordance with the invention, that at least one of the drive aggregates or boom arms is associated with at least one sensor for determining one of the mechanical oscillations of the concerned boom arm derived time-dependent amplitude or measurement values as well as an evaluation unit downstream of the sensor on the output side on the associated actuating mechanism for producing a damping signal.

According to a preferred embodiment of the invention each drive aggregate includes a double acting hydraulic cylinder, wherein the hydraulic cylinders are respectively acted upon by pressure oil via the associated actuating mechanism forming proportional change valve. In this case in accordance with the invention on the piston rod side and piston head side ends of at least one of the hydraulic cylinders there is respectively provided a pressure sensor, which is connected with the evaluation unit via a comparator or differential element. Preferably the evaluation unit includes a high pass filter, which can be digital or analog. Preferably the cutoff frequency of the high pass filter belonging to each boom arm can be separately set or adjusted depending upon the value of the inherent or harmonic frequency of the respective boom arm. Typical cutoff frequencies of the high pass filter may be 0.2 to 10 Hz.

A preferred embodiment of the invention envisions that the high pass filter is a deep pass filter, of which the input is connected to the output thereof via a differential element. In order to avoid oscillations, each high pass filter forms an aperiodic transition function. Further, in each high pass filter preferably an evaluation and safety circuit or routine is provided downstream, which on the input side can supplementally be acted upon with the output signals of the two pressure sensors of the associated hydraulic cylinder.

A preferred embodiment of the invention envisions, that the control device includes a micro-controller with coordinate sensors for controlling the actuating mechanisms, which on the input is acted upon via a BUS system and a remote control device with steering data for the boom movement, that each actuating element additionally is provided with a damping unit constituting carrier, which on the input side is acted upon by the applicable measurement amplitude belonging to the boom arm and on the output side is connected with the actuating element. Thereby the bendable boom can be controlled by the pump operator on the basis of movement data input into the remote control device, while the boom dampening occurs automatically during the movement process and while the bendable boom is in the work position. The dampened unit is thereby coupled into the control circuit of the individual drive aggregate. The individual carriers are preferably high pass filters of second order, of which the carrier or transmission function exhibits an aperiodic relationship. Therewith it is ensured that via the filter and this carrier no supplemental disturbance in the system is imprinted or added in. A peculiarity of the inventive dampening system is comprised therein that-each boom arm is provided with an independent damping unit.

As pressure sensors, one could contemplate membrane sensors or piezo sensors, to which in the case that a micro-controller is present a measurement converter with analog-digital converter is associated. It is important that the pressure sensors exhibit a sufficient range.

In the case that one position control fails, it is proposed in an alternative or advantageous embodiment of the invention that a device for drift compensation of the bendable boom is provided, which includes at least one inclination or distance sensor provided on one of the boom arms, and an intended value storage as well as a comparator connected on the input side with the intended value storage and with the output of the inclination or distance sensor, for controlling at least one of the actuating element. The inclination or distance sensor is preferably provided on the end arm of the bendable boom, while the intended value storage is acted upon via a control routine with the digital output signal of the inclination or distance sensor. The control routine ensure that the momentary inclination value or distance from the ground of the end arm is stored in the intended value storage upon reaching the work position of the bendable boom.

BRIEF DESCRIPTION OF THE DRAWINGS

In the following the invention will be described in greater detail on the basis of the illustrative embodiment represented schematically in the figure. There is shown FIG. 1 a side view of a mobile concrete pump with folded together bendable boom.

DETAILED DESCRIPTION OF THE INVENTION

Figure 1:
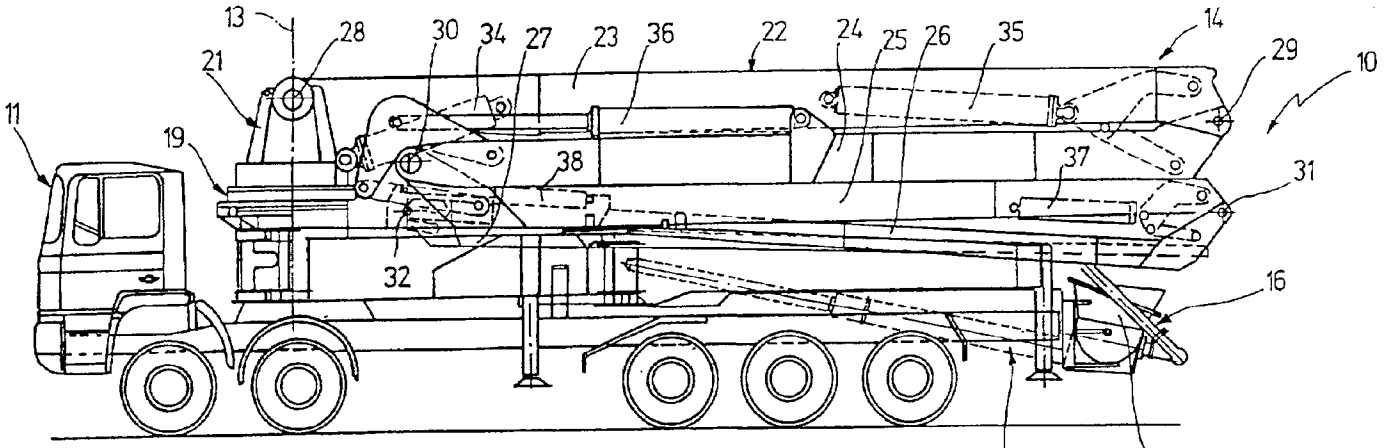

The mobile concrete pump 10 includes the transport vehicle 11, a pulsating thick matter pump 12 in the form for example a two-cylinder piston pump as well as a placement boom 14 rotatable about a vehicle fixed vertical axis 13 as carrier for a concrete delivery line 16. Via the delivery line 16 liquid concrete, which is continuously introduced into a feed container 12 during concretizing, is conveyed to a concretizing location 18 located distance from the location of the vehicle 11.

Figure 2:
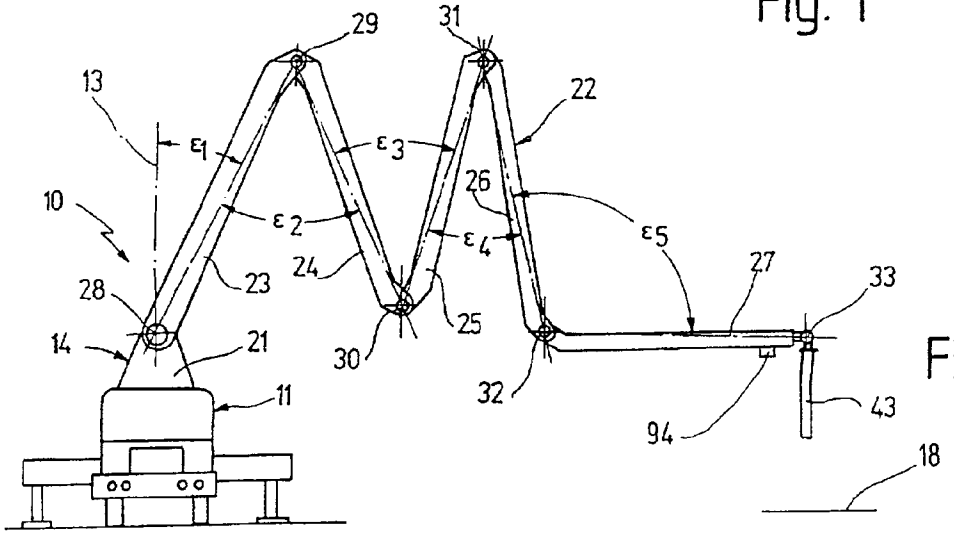
FIG. 2 the mobile concrete pump according to FIG. 1 with bendable boom in the work position.
Figure 3:
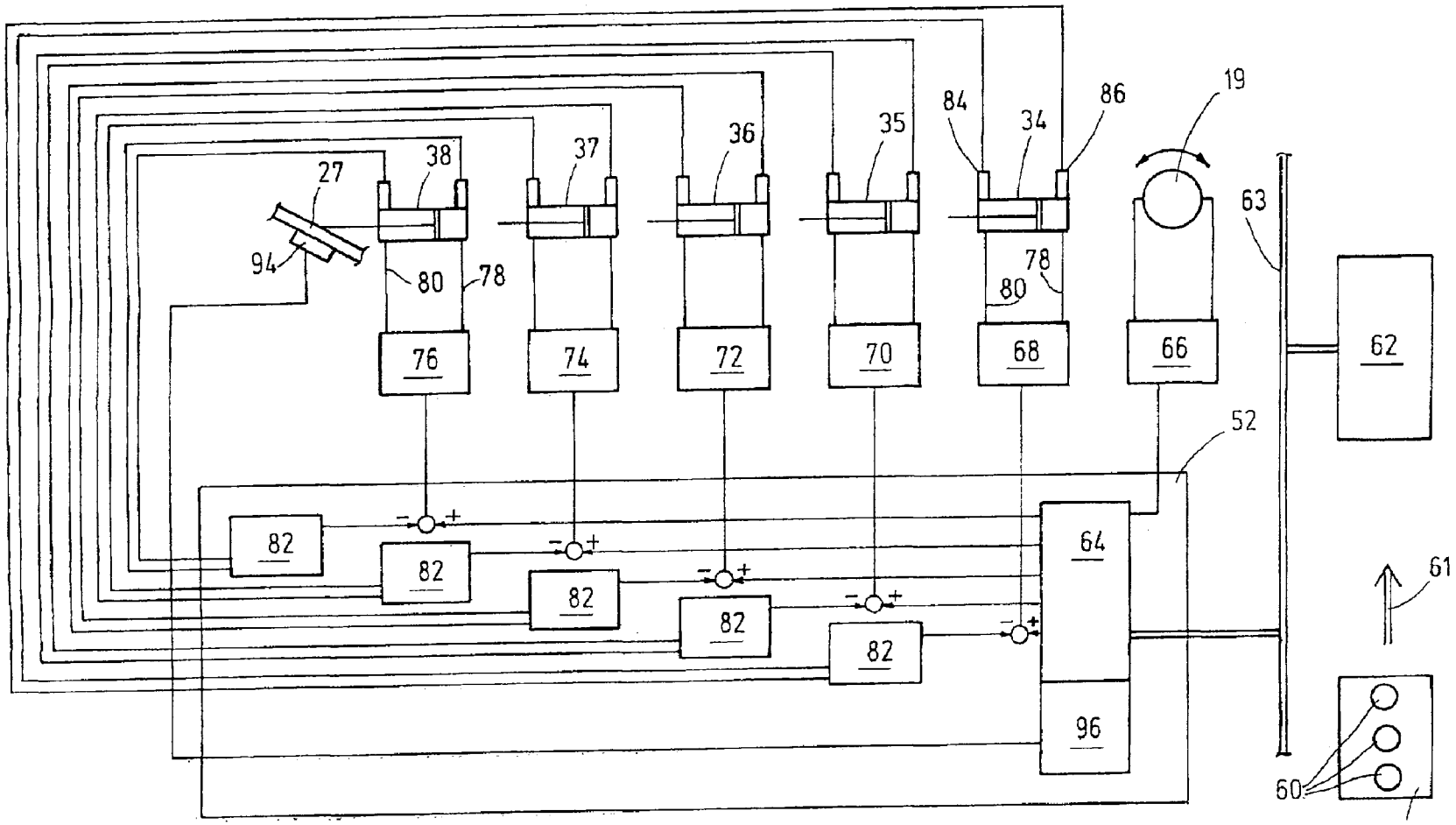
FIG. 3 a schematic of a control device for boom movement and dampening.

The placement boom 14 is comprised of a boom block 21 rotatable about the vertical axis 13 via a hydraulic rotation drive 19 and a thereupon pivotable bendable boom 22, which is continuously adjustable to variable reach and height differential between the vehicle 11 and the concretizing location 18. The bendable boom 22 is comprised in the shown embodiment of five boom arms 23 to 27 pivotably connected to each other, which are pivotable about axis 28 to 32 running parallel to each other and at right angles to the vertical axis 13 of the boom block 21. The bend angle $\epsilon_1$ to $\epsilon_5$ (FIG. 2) formed by the bend angles of the linkage axis 28 to 32 and their positioning relative to each other are so coordinated to each other, that the placement boom 14 as can be seen from FIG. 1 can be laid upon the vehicle 11 in a space-saving transport configuration by multiple folding. By program control activation of drive aggregates 34 to 38, which are individually associated with the linkage axis 28 to 32, the bendable boom is unfoldable to different distances and/or height differences relative to the concretizing location 18 and the location of the vehicle (FIG. 2).

The boom controller or driver controls the boom movement using for example a radio controlled remote control device 50, via which the boom tip 33 with the end hose 43 is moved over the area to be concretized. The end hose 43 has a typical length of 3 to 4 meters and can, as a result of its multi-linked hanging up in the area of the boom tip 33 and on the basis of its inherent flexibility, be held with its discharge end by a hose man in the desired position relative to the concretization location 18.

The remote control 50 contains multiple controlling elements 60 in the form of control levers, which can be adjusted in two adjustment directions perpendicularly to each other forwards and backwards with input of control signals. The control signals are transmitted via a wireless path 61 to the vehicle fixed radio receiver 62, which on the output side is connected with a micro-controller via a best system 63 in the form of for example CAN-bus. The micro-controller 52 contains among other things a computer controlled coordinate provider 64, in which the steering or control data relayed by the radio receiver 62 are converted into coordinate signals for the drive aggregates 19, 34 through 38 of the six axes 13, 28 to 32. In addition the size of the deflection of the operating element 60 can be converted into speed determining signals. The operation of the drive aggregates 34 to 38 occurs via the control elements 68 through 76 in the form of proportional changing valves, which are connected with their output lines 78, 80 to the piston head side and piston rod side to the double acting hydraulic cylinder drive aggregate 34 through 38. The drive aggregate 19 for boom block 21 is in the form of a hydraulic rotation drive, which is controlled via the control element 66. Besides the control via the coordinate provider 64, wherein the received drive data are interpreted, for example as cylindrical coordinates, and appropriately translated (see DE-A 43 06 127), the individual drive aggregates 19, 34 through 36 could also be directly controlled via the operating element 60 and the associated control elements 66 through 76.

The bendable boom 22 together with the transport vehicle 11 represents a system which may oscillate, and which in the operation of the pulsatingly-driven thick material pump 12 can be excited to oscillate. The oscillations can lead to deflections of the boom tip 33 and the therefrom hanging end hose 43, with amplitudes of 1 meter and frequencies of between 0.5 and several Hz.

Figure 4:
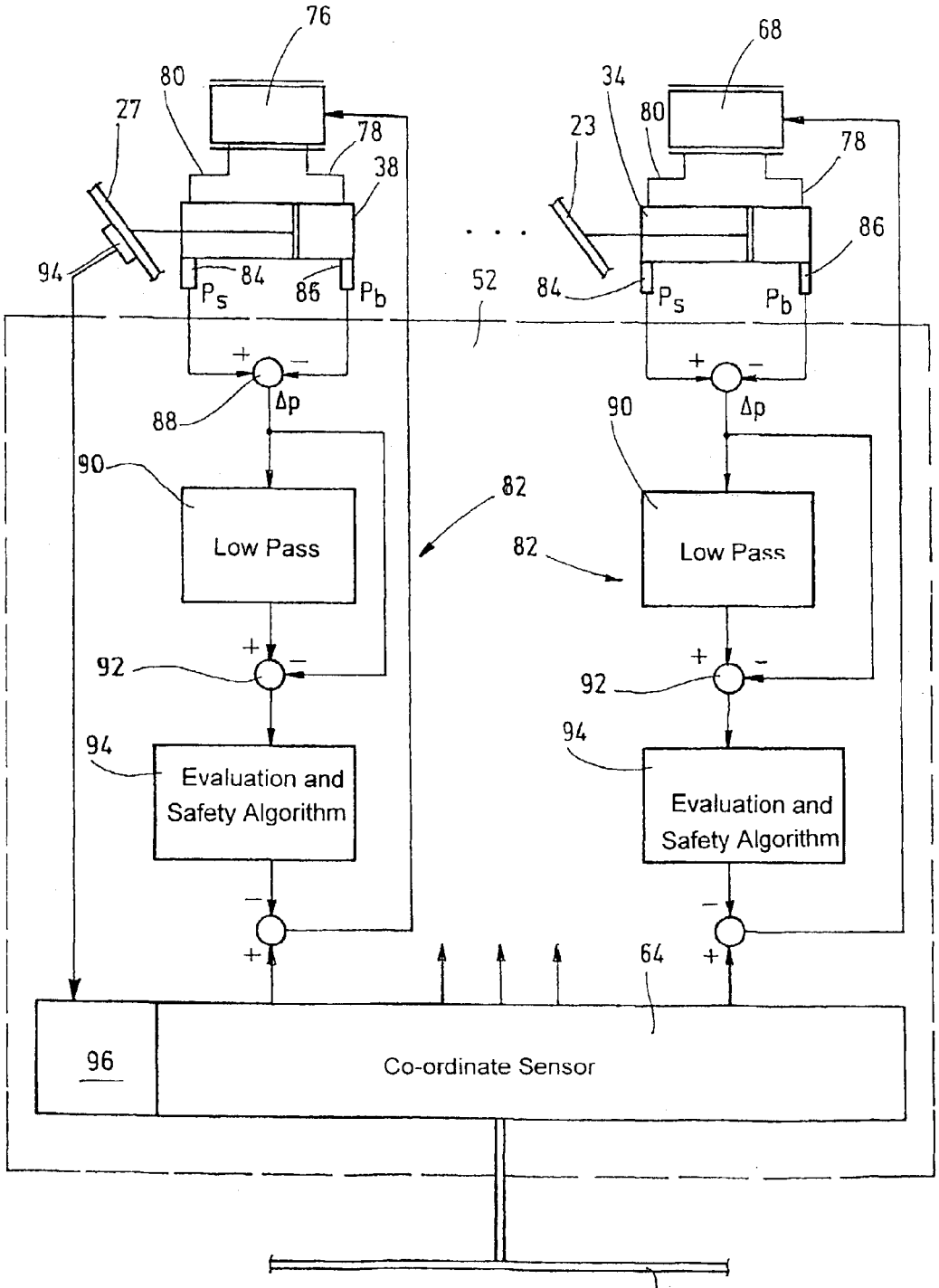
FIG. 4 a schematic with flow diagram of the micro-controller containing software carrier for the boom damping.

In order to avoid a resonance oscillation of the bendable boom, the micro-controllable 52 additionally includes a number of software supported damping units 82, which via the control unit are respectively connected with one of the actuating elements 68 through 76. On the input side the dampening units 82 are acted upon with a time-dependent amplitude, derived from the mechanical oscillations of the respective boom arm 23 through 27. In the shown illustrative embodiment for this purpose on the piston head side and piston rod side end of each drive aggregate 34 through 38 in the form of a hydraulic cylinder, there is provided a pressure sensor 84, 86 of which the outputs $p_s$ and $p_b$ are connected with a comparator 88, in which a time-dependent measurement signal corresponding to the pressure differential $\Delta p(t)=p_s-p_b$ is produced. The measurement signal $\Delta p(t)$ is fed to a digital high pass filter 90, 92 in a predetermined clock time. The high pass filter is formed in the illustrative example shown in FIG. 4 by a digital deep pass filter 90 with downstream computer 92, on the later of which additionally the input signal of the deep pass signal 90 is imposed. The cutoff frequency of the high pass filter 90, 92 is adjusted separately for each boom arm 23 through 27 and is somewhat lower than the mechanical harmonic frequency thereof. The actuating unit 82 additionally contains an evaluation and safety algorithm 93 downstream of the digital high pass filter 90, 92 for setting or adjusting the amplitude degree necessary for the oscillating damping. Further, using the safety algorithm, the movement boundary values of the boom arm are also monitored, for example, using an abutment or limiting control. For this, the absolute pressure values $p_s$ and $p_b$ measured by the piston head and piston rod sided pressure sensors 84, 86 can be evaluated.

Since the axial positions of the bend axes are not controlled, it cannot be ruled out, that on the basis of construction tolerances the drift movement of the bendable boom could occur. This is in particular the case in the work position of the bend boom during pumping operation. This drift can be monitored and compensated for. As can be seen from FIGS. 2 and 4, for this purpose on the last boom arm 27 a space angle sensor 94 in the form of for example an inclination sensor or a distance sensor as well an intended value storage 96 is provided. Therewith in each work position, that is, at the conclusion of each repositioning process, the instantaneous angular position or the distance of the boom tip 33 from the ground can be stored in the intended value storage 96. By comparison of the instantaneous value with the stored intended value then, over the course of time a drift can recognized and compensated by control of at least one of the actuating elements 68 through 76 or as the case may be via the coordinate provider 64.

In summary the following can be concluded: The invention relates to a large-scale manipulator, especially of concrete pumps. Said large-scale manipulator has a bending boom 22 which consists of at least three boom arms 23 to 27 and which is preferably configured as a concrete spreader boom. The arms of said boom are each pivotable to a limited extend about horizontal, bending axes 28 to 32 which are parallel to each other, by means of a drive aggregate 34 to 38, respectively. A control device 50, 62, 52 for moving the boom with the help of actuating mechanism that are allocated to the individual drive aggregates, and means for damping mechanical vibrations in the bending boom are also provided.

What is claimed is:

1. A large-scale manipulator, in particular for concrete pumps, with boom block (21) rotatable preferably about a vertical rotation axis (13) on a vehicle chassis (11), with a bendable boom (22) comprising an aggregate of at least three boom arms (23 through 27), preferably configured as a concrete placement boom, of which the boom arms (23 through 27) are pair-wise limitedly pivotable, relative to the adjacent boom block (21) or boom arm (28 to 26), about respective horizontal parallel pivot axes (28 to 32) by means of a drive aggregate (34 through 38), with a preferably remote-controlled control device (50, 62, 52) for movement of the boom with the aid of individual actuating elements (68 through 76) associated with the individual drive aggregates (34 through 38), and with means (82, 84, 86) for damping of mechanical oscillations in the bendable boom (22), wherein at least one of the drive aggregates (34 through 38) or boom arms (23 through 27) is provided with a sensor (84, 86) for determining a time dependent measurement value ($\Delta p$) derived from the mechanical oscillations of a boom arm (23 through 27), as well as an evaluation unit (82) for producing a damping signal connected downstream of the at least one sensor (48, 86), of which the output is connected to the associated actuating element (68 through 76).

2. A large-scale manipulator according to claim 1, wherein each drive aggregate (34 through 38) includes a double acting hydraulic cylinder, that the hydraulic cylinder is acted upon by pressure oil via a proportional change valve (68 through 76) forming the associated actuating element, that on the piston rod sided and piston head sided end of at least one of the hydraulic cylinders respectively a pressure sensor (84, 86) is provided, which is connected with the evaluation unit (82) preferably via a comparator (88).

3. A large-scale manipulator according to claim 2, wherein the evaluation unit (82) includes an analog or digital high pass filter (90, 92).

4. A large-scale manipulator according to claim 3, wherein the cutoff frequency of the high pass filters (90, 92) belonging to the individual boom arms (23 through 27) are independently adjustable.

5. A large-scale manipulator according to claim 3, wherein that the cutoff frequency of the high pass filter (90, 92) is adjustable according to the value of the harmonic frequency of the associated boom arm (23 through 27).

6. A large-scale manipulator according to claim 3, wherein the cutoff frequency of the high pass filter (90, 92) is adjustable to a value of from 0.2 to 10 Hz.

7. A large-scale manipulator according to claim 3, wherein each high pass filter is a deep pass filter (90), of which the input is imposed on the output thereof via a comparator (92).

8. A large-scale manipulator according to claim 3, wherein each high pass filter (90, 92) provides an aperiodic transmission or carrier function.

9. A large-scale manipulator according to claim 3, wherein each high pass filter (90, 92) has an evaluation and safety circuit or routine (93) connected downstream.

10. A large-scale manipulator according to claim 9, wherein the evaluation and safety circuit or routine (90) is acted on on the input side with the output signals ($P_s$, $P_b$) of the two pressure sensors (84, 86).

11. A large-scale manipulator according to claim 1, wherein the control device includes a micro-controller (52) with a coordinate provider (64) for controlling the actuating elements (68 through 76), which on the input side is acted upon via a BUS-system (63) and a remote control device (50, 64) with steering data for the boom movement, that each actuating element is provided with a carrier or transmitter forming a damping unit (82), which on the input side is acted upon with the measurement value ($\Delta p$) belonging to the concerned boom arm (23 through 27).

12. A large-scale manipulator according to claim 1, wherein a device for drift compensation of the placement boom (22), which includes at least one inclination sensor (94) or distance sensor provided on an end of the boom arm (27), a storage unit (96) as well as a computer connected with the intended value storage and the output of the space angle or distance sensor for controlling at least one of the actuating elements (68 through 76).

13. A large-scale manipulator according to claim 12, wherein the inclination or distance sensor is provided on the end arm (27) of the bendable boom (22).

14. A large-scale manipulator according to claim 12, wherein the intended value storage (96) is acted upon via a control routine with the digital output signal of the inclination or distance sensor (94).

15. A large-scale manipulator, in particular for concrete pumps, with boom block (21) rotatable preferably about a vertical rotation axis (13) on a vehicle chassis (11), with a bendable boom (22) comprising an aggregate of at least three boom arms (23 through 27), preferably configured as a concrete placement boom, of which the boom arms (23 through 27) are pair-wise limitedly pivotable, relative to the adjacent boom block (21) or boom arm (28 to 26), about respective horizontal parallel pivot axes (28 to 32) by means of a drive aggregate (34 through 38), with a preferably remote-controlled control device (50, 62, 52) for movement of the boom with the aid of individual actuating elements (68 through 76) associated with the individual drive aggregates (34 through 38), and with means (82, 84, 86) for damping of mechanical oscillations in the bendable boom (22), wherein a device for drift compensation of the placement boom (22), which includes at least one inclination sensor (94) or distance sensor provided on an end of the boom arm (27), a storage unit (96) as well as a computer connected with the intended value storage and the output of the space angle or distance sensor for controlling at least one of the actuating elements (68 through 76).

16. A process for dampening mechanical oscillations of a bendable boom (22) of a large-scale manipulator, in which boom arms (23 through 27) of the bendable boom (22) are pivotable relative to each other via respectively one drive aggregate (34 through 38), wherein a time dependent measurement value ($\Delta p$) dependent upon the mechanical oscillation of the concerned boom arm is derived from at least one of the drive aggregates (34 through 38) or on the associated boom arm (23 through 27), is submitted to an evaluation unit (82) with formation of a dynamic damping signal, and is imposed upon the actuating element (68 through 76) controlling the drive aggregate.

17. A process according to claim 16, wherein the drive aggregate (34 through 38) is a hydraulic cylinder in which the time dependent pressure deferential ($\Delta p$) between the piston head side and piston rod side are measured as the measurement amplitude or value and evaluated in the evaluation unit (82) with formation of the dampening signal.

18. A process according to claim 16, wherein in the evaluation unit (82, 90, 92) the dynamic portion of the measurement value ($\Delta p$) above a defined cutoff frequency is filtered out and phase delayed and/or amplified for the formation of the damping signal.

19. A process according to claim 18, wherein the cutoff frequency is set depending upon the value of the mechanical harmonic frequency of the concerned boom arm, preferably to a value of 0.2 to 10 Hz.

20. A process according to claim 16, wherein in the case of a bendable boom (22) extended to a work position the inclination or the distance from the ground of the end arm is measured in predetermined time intervals and compared to a previously stored intended value, and that upon occurrence of a deviation from the intended value the bendable boom is restored by control of at least one of the actuating elements (68 through 76).

21. A process for damping mechanical oscillations of a bendable boom (22) of a large-scale manipulator, in which boom arms (23 through 27) of the bendable boom (22) are pivotable relative to each other via respectively one drive aggregate (34 through 38), wherein in the case of a bendable boom (22) extended to a work position the inclination or the distance from the ground of the end arm is measured in predetermined time intervals and compared to a previously stored intended value, and that upon occurrence of a deviation from the intended value the bendable boom is restored by control of at least one of the actuating elements (68 through 76).

* * * * *